US007555209B2

(12) United States Patent
Pradas Diez et al.

(10) Patent No.: US 7,555,209 B2
(45) Date of Patent: Jun. 30, 2009

(54) HAND DRYER

(76) Inventors: Jorge Pradas Diez, Solsones, 57 Pol. Ind. Pla de la Bruguera, Castellar del Valles, Barcelona (ES) 08211; Miguel Canut Cristobal, Solsones, 57 Pol. Ind. Pla de la Bruguera, Castellar del Valles, Barcelona (ES) 08211

( * ) Notice: Subject to any disclaimer, the term of this patent is extended or adjusted under 35 U.S.C. 154(b) by 331 days.

(21) Appl. No.: 11/574,851

(22) PCT Filed: Oct. 4, 2005

(86) PCT No.: PCT/ES2005/070138

§ 371 (c)(1),
(2), (4) Date: Mar. 7, 2007

(87) PCT Pub. No.: WO2006/042896

PCT Pub. Date: Apr. 27, 2006

(65) Prior Publication Data

US 2007/0263994 A1 Nov. 15, 2007

(30) Foreign Application Priority Data

Oct. 18, 2004 (ES) ..... 200402353 U
Feb. 16, 2005 (ES) ..... 200500359 U
Jun. 13, 2005 (ES) ..... 200501353 U

(51) Int. Cl.
*A47J 27/00* (2006.01)
*F26B 19/00* (2006.01)

(52) U.S. Cl. ..... 392/380; 34/202; 34/205

(58) Field of Classification Search ..... 34/202, 34/205, 218, 230

See application file for complete search history.

(56) References Cited

U.S. PATENT DOCUMENTS 4,336,619 A 6/1982 Hinkel et al.
4,754,769 A * 7/1988 Flynn ..... 132/73.5
5,459,944 A * 10/1995 Tatsutani et al. ..... 34/202
5,826,347 A * 10/1998 Olivares-Gonzalez de Serrano et al. ..... 34/202
6,038,786 A * 3/2000 Aisenberg et al. ..... 34/267
6,189,230 B1 * 2/2001 Huen ..... 34/90
D548,399 S * 8/2007 Nikaido et al. ..... D28/54.1
7,437,833 B2 * 10/2008 Sato et al. ..... 34/90
2007/0079524 A1 * 4/2007 Sato et al. ..... 34/202
2007/0263994 A1 * 11/2007 Diez et al. ..... 392/380

(Continued)

FOREIGN PATENT DOCUMENTS

DE 548998 4/1932

(Continued)

*Primary Examiner*—Thor S Campbell
(74) *Attorney, Agent, or Firm*—Brown & Michaels, PC

(57) ABSTRACT

The present invention relates to a hand dryer comprising inside the casing (1) two hollow chambers (3*a*, 3*b*) having: a mouth (36) for the inlet of high-speed air supplied by air propulsion means (4*a*, 4*b*) towards a drying chamber (2), inner channels (33) for the conduction and distribution of air through the inside of said hollow chambers with a low coefficient of friction, and a plurality of air outlet orifices (34) defined in the front plates (31) of the hollow chambers and simultaneously projecting air through orifices (21, 22) of the drying chamber onto the entire surface of the hands inserted and kept still inside said drying chamber (2). The dryer comprises an evaporation device (7) to evaporate the water from the drying chamber (2).

14 Claims, 11 Drawing Sheets

U.S. PATENT DOCUMENTS

| | | | | |
|---|---|---|---|---|
| 2008/0209760 | A1* | 9/2008 | French et al. | 34/585 |
| 2008/0216342 | A1* | 9/2008 | Kameishi et al. | 34/202 |
| 2008/0216343 | A1* | 9/2008 | Churchill et al. | 34/202 |
| 2008/0317448 | A1* | 12/2008 | Brown et al. | 392/380 |
| 2009/0000142 | A1* | 1/2009 | Churchill et al. | 34/95 |
| 2009/0034946 | A1* | 2/2009 | Caine et al. | 392/380 |

FOREIGN PATENT DOCUMENTS

| | | | |
|---|---|---|---|
| EP | 0589568 | A1 | 3/1994 |
| GB | 2249026 | A | 4/1992 |
| JP | 9299279 | A | 11/1997 |
| JP | 2000245652 | A | 9/2000 |
| JP | 2001104213 | A | 4/2001 |
| JP | 2001299636 | A | 10/2001 |
| JP | 2002034847 | A | 2/2002 |

* cited by examiner

HAND DRYER

OBJECT OF THE INVENTION

The present invention relates to a hand dryer, of the type of the comprising: a casing, a drying chamber integrated in the casing for inserting hands, means for propelling air at room temperature at a high speed, presence or proximity detectors for the automatic actuation of the dryer when the user inserts his or her hands in the drying chamber, an electronic control card, means for collecting the water released from the user's hands during drying, and at least two air outlet groups arranged in opposite front and back walls of the drying chamber, each of said groups comprising several outlets.

BACKGROUND OF THE INVENTION

Different hand dryers are known today which have a drying chamber so that the user can insert his or her hands therein and dry them, said drying chamber having outlets for projecting air on the user's hands.

Patent document JP2000245652 discloses a hand dryer having a drying chamber tilted towards the front area for inserting the user's hands and provided with air outlet orifices arranged in the side and upper walls of said drying chamber. Said orifices are connected by means of multiple ducts to a blower propelling the air towards said outlets. The side and upper arrangement of the outlets prevents the projected air from simultaneously acting on the obverse and reverse sides of two hands, requiring the user to change his or her hands from their position in order to completely dry them.

Patent document JP2002034847 discloses a hand dryer having a drying chamber closed on all its sides and provided with an upper mouth for inserting the user's hands. Said drying chamber has in opposite front and back walls respective rows of air outlet orifices, requiring the user to move his or her hands during drying so that the supplied air can act on different areas of his or her hands, prolonging drying time. The air projected through the two rows of orifices is supplied by a single ventilator and guided through a single inner chamber towards the two opposite sides of the dryer, which causes the airflow to split and changes in direction, generating significant pressure drops in the air conduction and an outlet speed reduction.

Patent document DE548998 discloses a hand dryer having a considerably spherical drying chamber open at one of its ends and inside of which two nozzles are arranged in opposite positions that are responsible for projecting the air onto the user's hands inserted in the aforementioned chamber.

In this patent the nozzles or outlets have a small surface, requiring the user to move his or her hands inside the chamber in order to dry them. In addition, the vertical orientation of the air nozzles or outlets necessitates that the hands be inserted inside the chamber in a considerably horizontal position, preventing the force of gravity from assisting the air outlets in eliminating the water existing on the user's hands.

In patent document GB2249026 discloses a hand dryer with a chamber for inserting the user's hands. Said chamber has in one of its sides an elongated air outlet opening in the shape of a blade, said opening being connected to an air supply duct by means of an enveloping hollow surrounding the aforementioned drying chamber.

In this patent, the elongated shape of the air outlet opening determines that the projected air blade or curtain acts on a small surface of the hand inserted in the drying chamber, requiring the user to move his or her hand inside the aforementioned chamber to effectively dry the entire surface of his or her hand.

Patent document U.S. Pat. No. 4,336,619 discloses a hand washing and drying device having a working enclosure or chamber tilted towards the lower back area and provided with a mouth in the upper front area for inserting the hands to be washed and dried. Said chamber has an orifice at the upper portion for the outlet of the water required to wash hands and an air outlet in which propulsion means are associated, forming a dryer strictly speaking.

In this patent the user must insert his or her hands inside the chamber in order to wash and then dry them, the projection of the air on the hands being done in the same way as in the previously discussed patents, in virtually a very localized manner, requiring the user to move his or her hands inside the chamber in order to completely dry them, this operation involving an excessive time.

Patent document EP0589568 discloses a hand dryer having a hand insertion unit which is tilted towards the lower back area and open towards the upper front area and the sides, said hand insertion unit having outlets in the two front and back faces provided with respective alignments of orifices for projecting respective air curtains on the obverse and reverse sides of the user's hands inserted in a tilted position inside the drying unit.

In this case, like in the aforementioned patent document U.S. Pat. No. 4,336,619 the user's hands are inserted in the drying unit in a tilted position, therefore gravity has little effect on eliminating the water deposited on the hands towards the lower area of the chamber. Also with the described embodiment, in patent EP0589568 the projection of air on the user's hands is done in localized areas, requiring the user to move his or her hands inside the drying unit so that the air can act on different areas of his or her hands.

In some of the mentioned documents the projection of air on the hands is done at high pressure, being propelled by turbines connected to the mentioned outlets by means of pipes generating turbulences in the circulating air and considerably reducing the air outlet speed towards the drying chamber or unit.

One of the mentioned dryers also has at the bottom of the drying chamber or unit a drain pipe for draining the water released by the user's hands towards a drain (U.S. Pat. No. 4,336,619) or towards a water collection tray (EPO589568), this second case requires manually emptying the water collection tray on a rather frequent basis.

If this tray is not emptied as frequently as it should be, the water accumulated therein will end up overflowing and falling towards the lower area, with the subsequent risk of damage to the dryer and of spilling onto the user.

DESCRIPTION OF THE INVENTION

The hand dryer object of the present invention has a series of constructive particularities aimed at allowing high-speed air projection at room temperature and simultaneously on the entire surface of the obverse and reverse sides of the user's hands, said drying chamber having to that end a plurality of orifices distributed on the entire surface of the opposite walls of said drying chamber.

Another object of the invention is to prevent the ducts that are responsible for conducting the air provided by the high-speed air propulsion means to the outlets of the drying chamber from causing a considerable decrease in said speed of the circulate airflow, the dryer having to that end hollow air distribution chambers arranged inside the casing and opposite to the opposite walls of the drying chamber, each of said hollow chambers being formed by respective pairs of front and back plates mutually opposite and fixed to one another by way of a sandwich.

Said hollow chambers comprise: a mouth for the inlet of high-speed air supplied by the propulsion means, inner channels for the conduction and distribution of air through the inside of said hollow chambers with a low coefficient of friction and plurality of air outlet orifices defined in the front plates of each of the hollow chambers and opposite to the respective orifices of the opposite walls of the drying chamber.

The aforementioned hollow chambers, with a relatively flattened configuration, have a surface that is equal to or somewhat smaller than the surface of the opposite walls of the drying chamber such that the air supplied by the high-speed air propulsion means is conducted directly by said hollow chambers towards the inside of the drying chamber.

To increase the air outlet speed it has been provided that the front plates of the hollow chambers externally have tubular extensions arranged in correspondence with the air outlet orifices defined in said front plates, these orifices having a decreasing section inside the aforementioned tubular extensions.

Taking into account that said hollow chambers have respective pluralities of orifices for projecting air towards the inside of the drying chamber, it has been provided that the air propulsion means are formed by two turbine motors housed inside the casing and directly and independently connected to the respective inlet mouths of the hollow chambers, each of the turbine motors supplying high-speed air to the respective hollow chamber.

Another object of the invention is to provide the drying chamber with a suitable configuration so that the force of gravity assists the air projected on the entire surface of the hands so that the water is easily released from said hands during the drying process, further allowing the user to insert his or her hands inside the drying chamber in a comfortable manner and in an ergonomic position. For that purpose the drying chamber is oriented vertically and open towards the upper area and towards the sides in divergent directions towards the front of the dryer, said drying chamber having a "V"-shaped configuration in plan view with the intermediate edge or vertex orientated towards the back middle area of the casing. The vertical orientation of the drying chamber and the "V"-shaped configuration in plan view allows the user to comfortably insert his or her hands inside said chamber by orienting his or her semi-bent arms towards the lower front area. Additionally, the front and back walls diverge slightly towards the upper area, which is where hands are the thickest.

With the described features, the dryer can have an extractable tray inside the casing, which tray can be accessed by a drain duct to drain the water released from the user's hands inside the drying chamber.

Optionally and for the purpose of solving the problem involved in emptying the water accumulated in said collection tray, this invention contemplates the replacement of the aforementioned tray with an evaporation device that is responsible for evaporating the water entering said device from the drying chamber, said device including a low capacity electrical resistor controlled by the electronic control card of the dryer and a ventilator propelling the generated steam towards the outside of the casing.

These and other features of the invention comprised in the claims will be more easily understood in view of the attached figures described below.

DESCRIPTION OF THE DRAWINGS

To complement the description being made and for the purpose of facilitating understanding of the features of the invention, a set of drawings is attached to the present specification in which the following has been depicted with an illustrative and non-limiting character.

PREFERRED EMBODIMENT OF THE INVENTION

Figure 6:
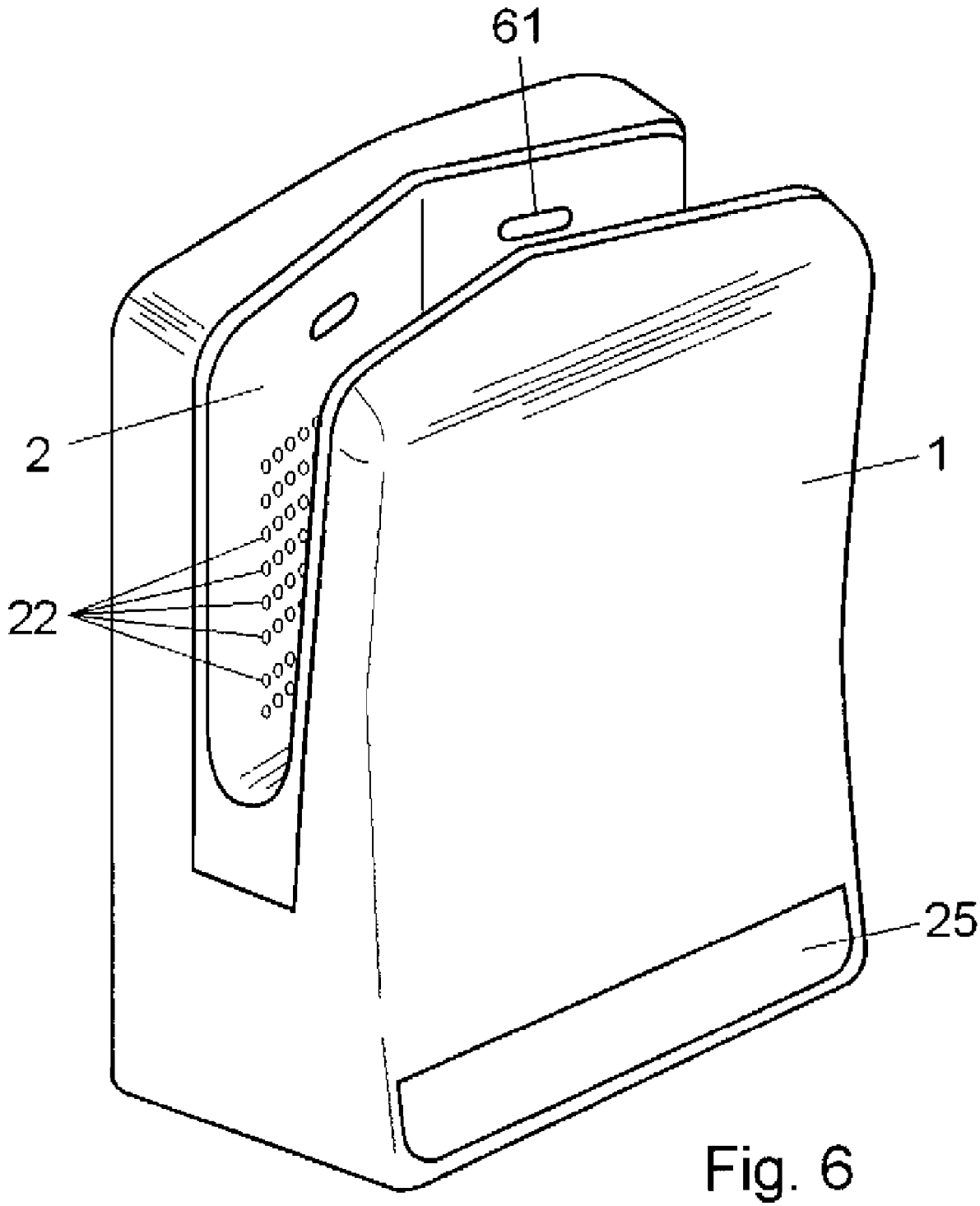
FIG. 6 shows a perspective view of an embodiment of the dryer provided with a water collection tray.
Figure 8:
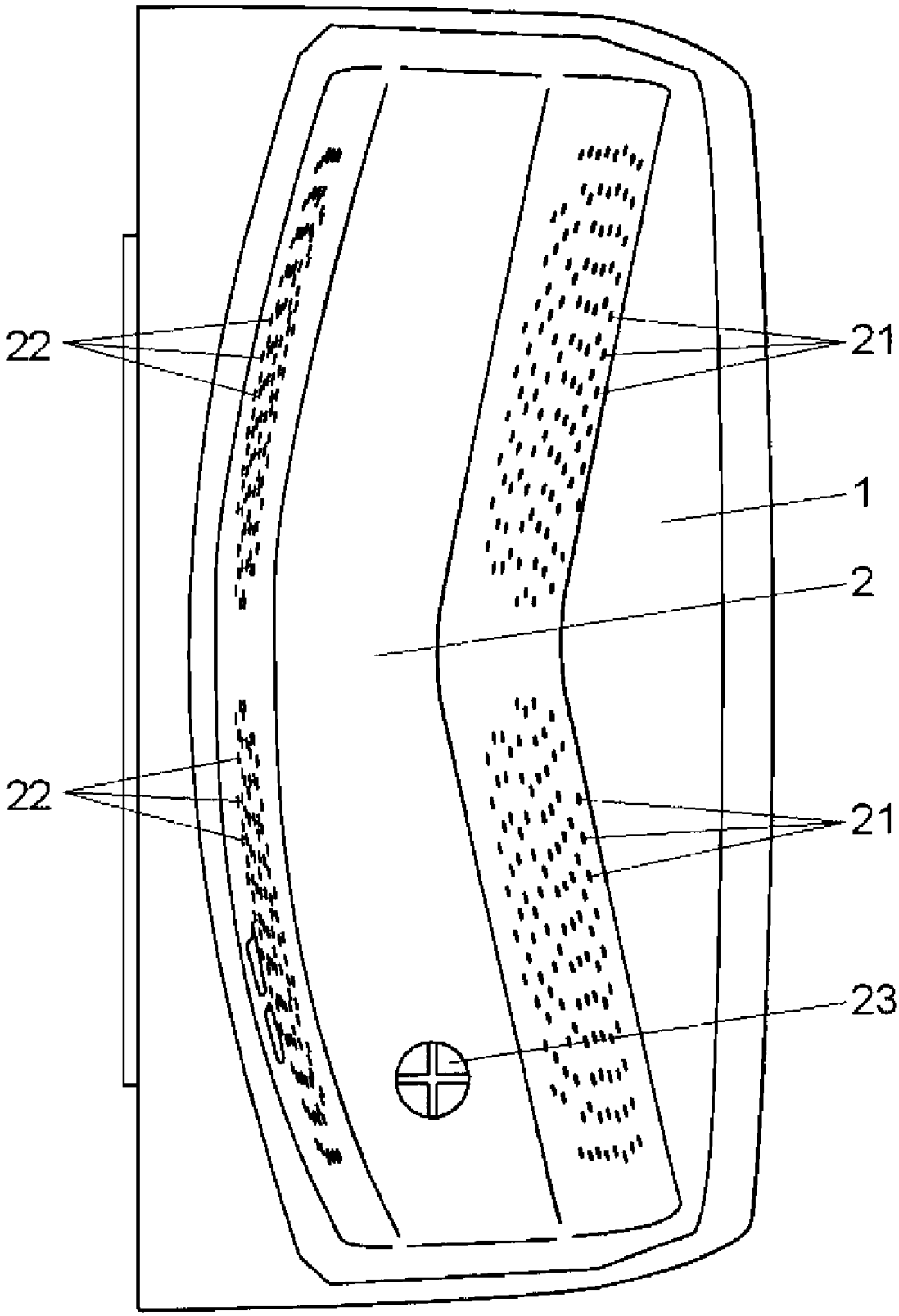
FIG. 8 shows an upper plan view of the dryer in which the "V"-shaped configuration of the drying chamber and the divergence of the opposite walls of said drying chamber towards the upper area can be seen.
Figure 9:
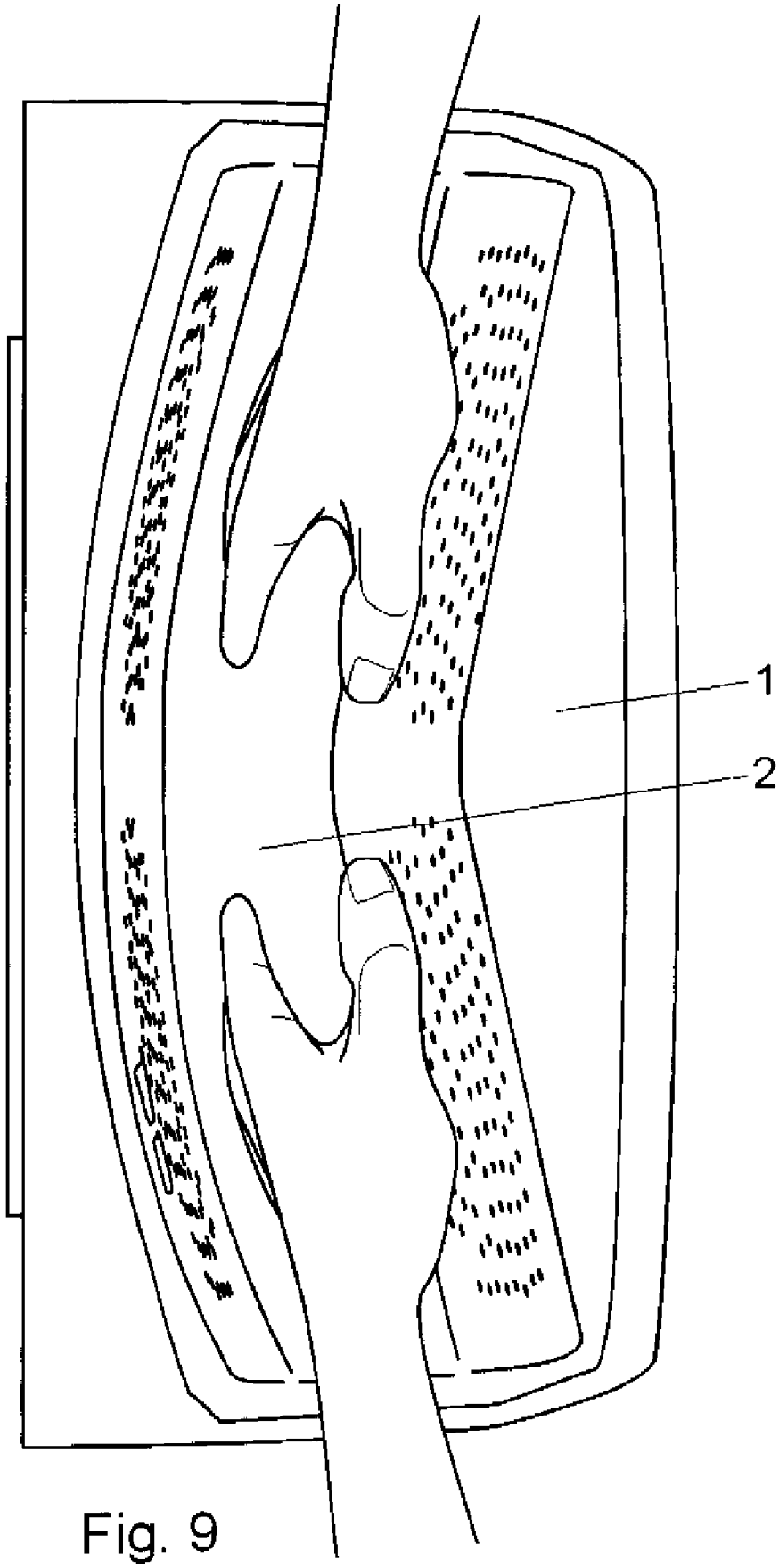
FIG. 9 shows an upper plan view of the dryer in which the position of the user's hands placed inside the dryer during the drying operation can be seen.

As can be seen in the attached figures, the hand dryer comprises a casing (1) in which a drying chamber (2) is integrated for the user to insert his or her hands. Said drying chamber (2) is open vertically at its upper area and at the sides, defining a "V"—type section in plan view as can be seen in FIGS. 6, 8 and 9.

Figure 7:
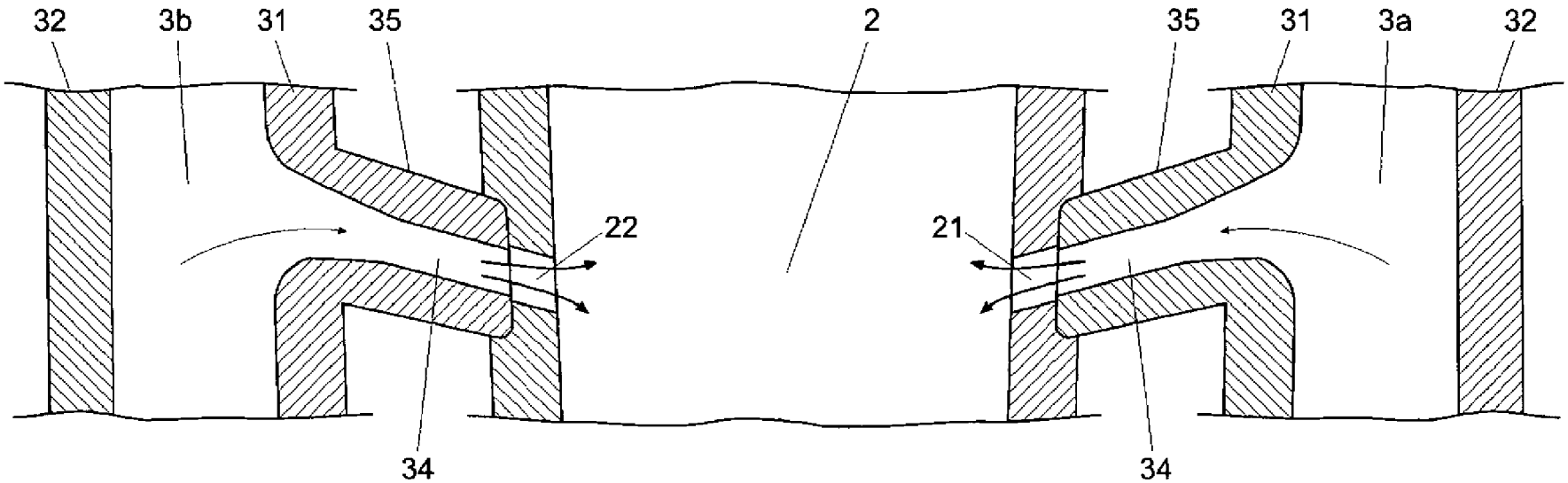
FIG. 7 shows a partial profile view of the dryer in which the geometry of the tubular extensions of the front wall of the hollow chambers and the opposite position of said tubular extensions with the air outlet orifices defined in the drying chamber can be seen.

The front and back walls of the drying chamber have on their entire surface a plurality of orifices (21 and 22), respectively, slightly tilted towards the lower area as can be seen in FIG. 7, therefore high-speed air at room temperature is projected on the entire surface of the user's hands.

Two hollow chambers (3*a* and 3*b*) are located inside the casing, each of them demarcated by a front plate (31) and a back plate (32) mutually opposite and fixed to one another; said hollow chambers (3*a* and 3*b*) opposite to the front and back walls of the drying chamber.

Each of the hollow chambers (3*a* and 3*b*) has a lower mouth (36) for the inlet of high-speed air propelled by respective turbine motors (4*a*, 4*b*). The hollow chambers (3*a* and 3*b*) internally have, specifically in the back plates (32), channels (33) for the conduction and distribution of air through the inside of said chambers with a low coefficient of friction, the front plates (31) of each of the hollow chambers (3*a* and 3*b*) having a plurality of air outlet orifices (34).

The front plates (31) of the hollow chambers (3*a* and 3*b*) externally have, and in correspondence with the orifices (34) tubular extensions (35) the ends of which fit into countersinkings defined in the orifices (21 and 22) of the front and back walls of the drying chamber, ensuring the centering of the air outlet orifices (34) with the orifices (21 and 22) of the drying chamber.

The tubular extensions (35) (FIG. 7) are slightly tilted towards the lower area for the purpose of quickly releasing the water from the user's hands, assisted by gravity.

Figure 2:
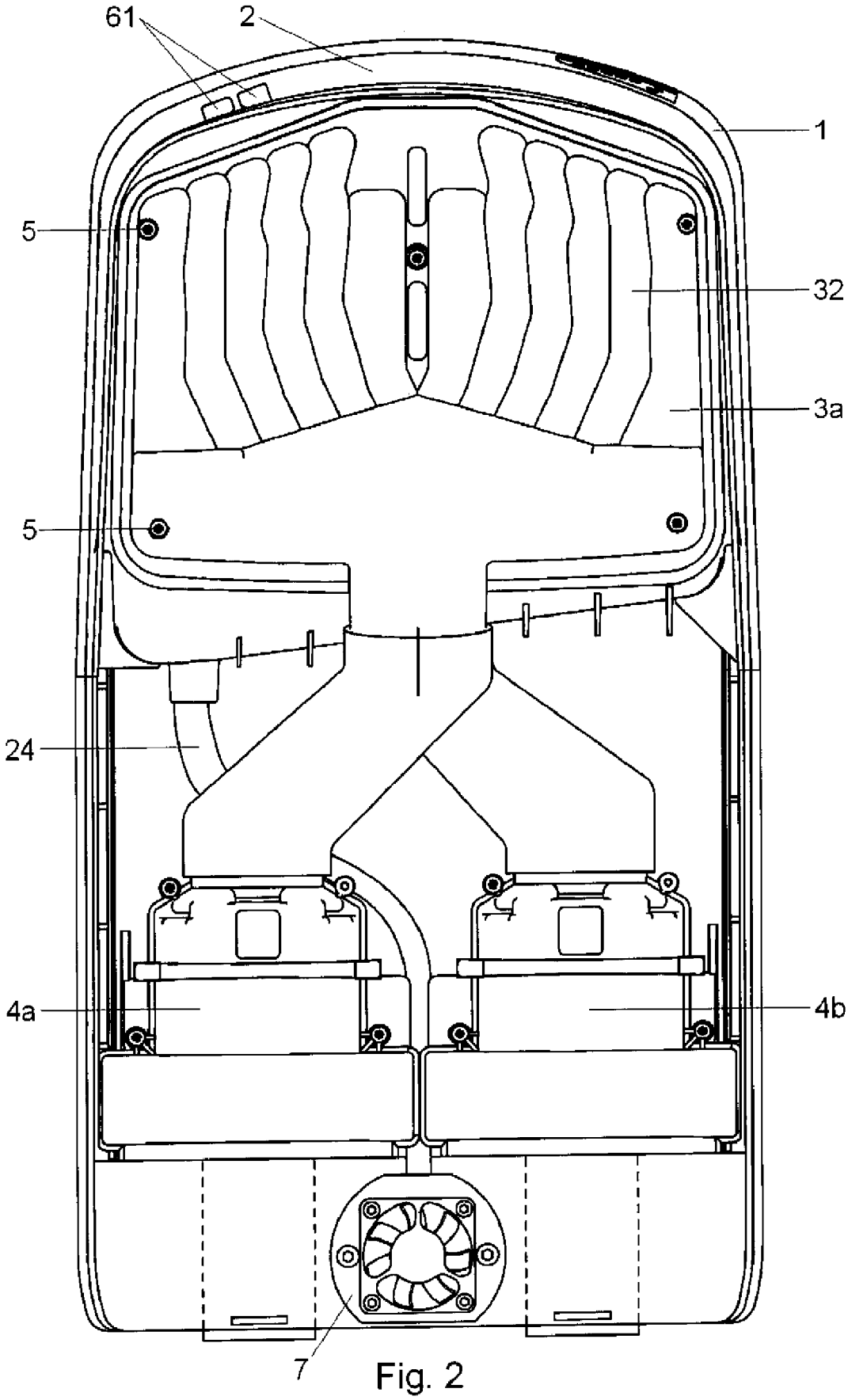
FIG. 2 shows a front elevational view of the hand dryer in which the front wall of the casing has been eliminated, an evaporation device being provided in this case for eliminating the water from the drying chamber.
Figure 3:
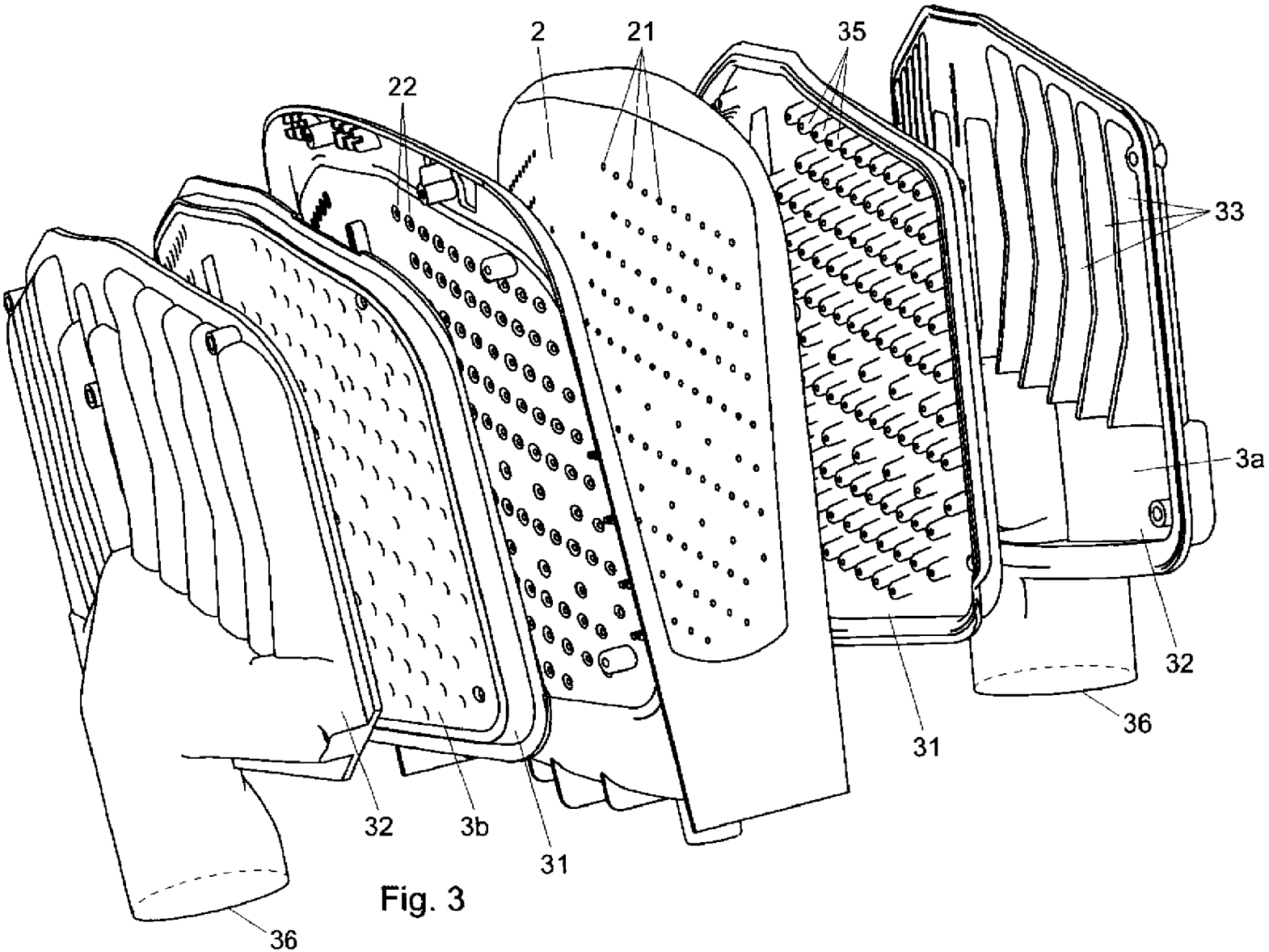
FIG. 3 shows an exploded perspective view of the two hollow chambers arranged on opposite sides of the drying chamber and intended to conduct the air provided by the air propulsion means towards the inside of the drying chamber.
Figure 4:
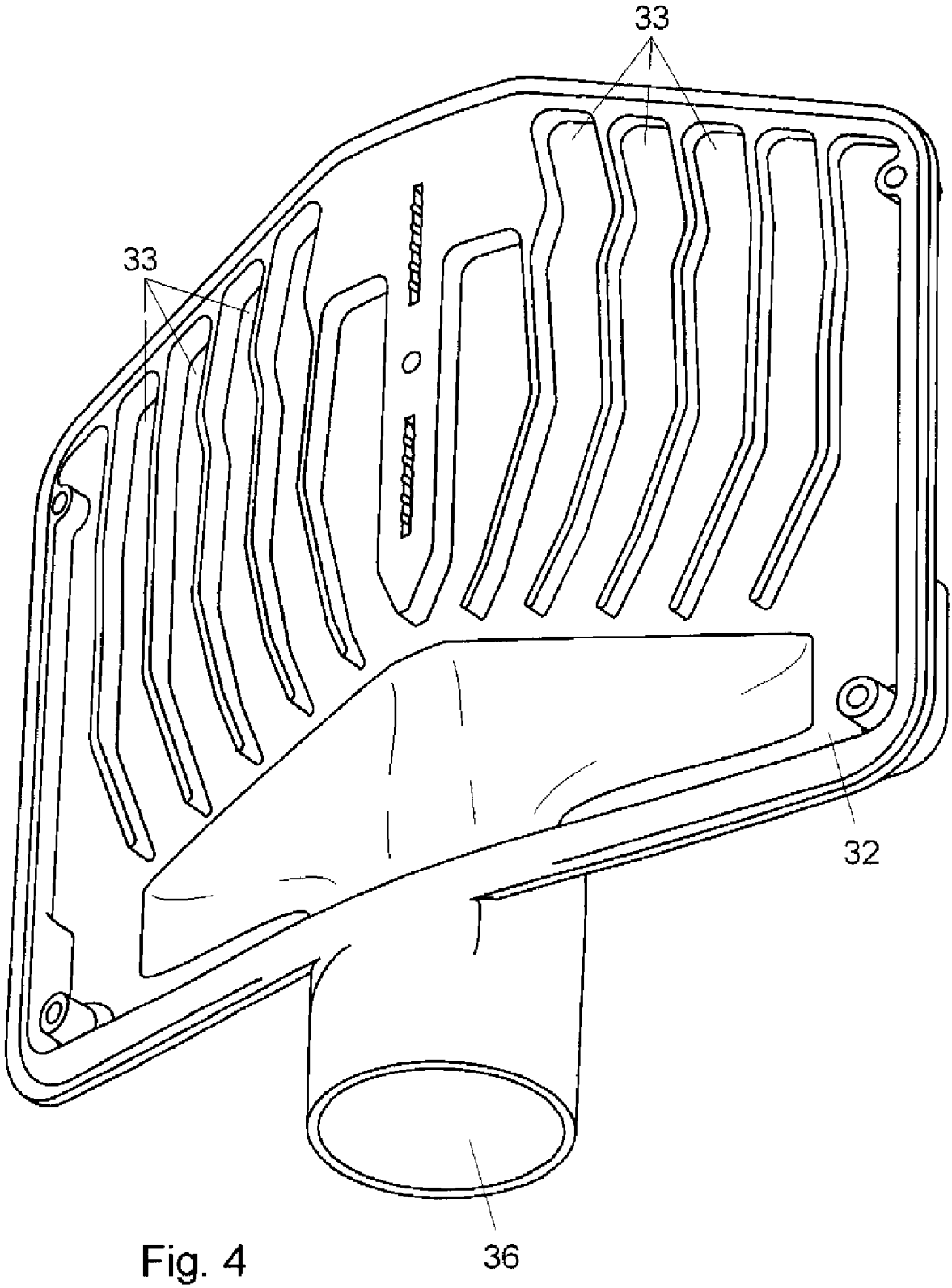
FIG. 4 shows a perspective view of the back wall of one of the hollow chambers in which the inner air inlet mouth and inner channels for the conduction and distribution of the air through the inside of the hollow chamber can be seen.
Figure 5:
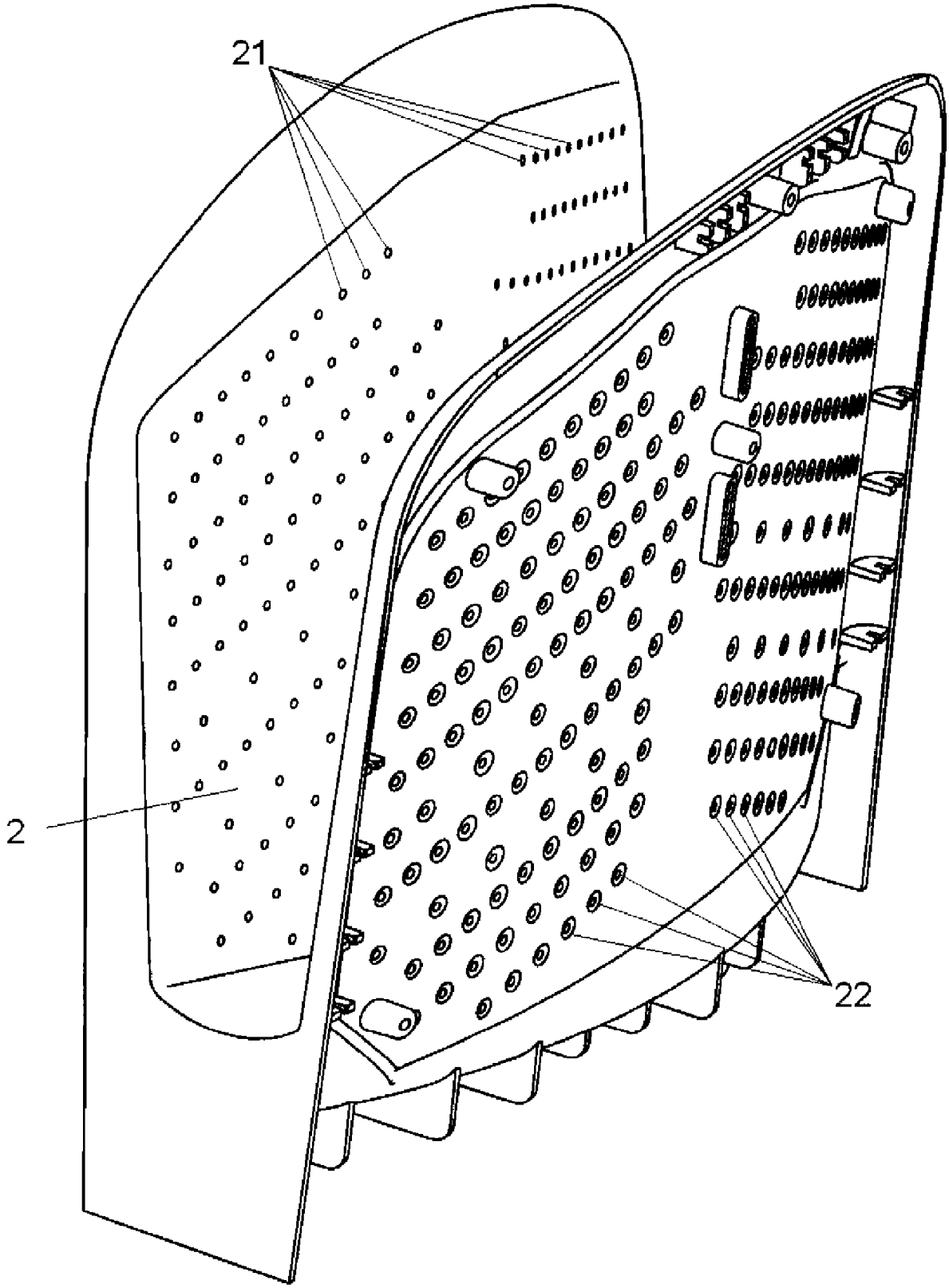
FIG. 5 shows a perspective view of the part of the casing forming the drying chamber.

The assembly of the pairs of plates (31 and 32) forming the hollow chambers (3*a* and 3*b*) is done by overlapping, each of said hollow chambers being fixed to the corresponding wall of the drying chamber with coupling means, for example lugs and orifices, being able to be fixed in said positions by means of screws (5), as shown in FIG. 2.

The air outlet orifices (34) defined in the front plates (31) of the hollow chambers have a decreasing section inside the tubular extensions (35), which determines an acceleration of the air circulating at the time of being introduced towards the drying chamber (2).

The front and back chambers (3*a* and 3*b*) allow the circulation of the high-speed air through the inside thereof, with a low coefficient of friction, which provides together with the decreasing section of the outlet orifices (34) that the air is projected towards the inside of the drying chamber and simultaneously through all of the outlet orifices at a speed comprised between 50 and 60 meters per second.

The propulsion means or turbine motors (4*a* and 4*b*) that are responsible for propelling the air towards the hollow chambers (3*a* and 3*b*) and simultaneously projecting it through all the orifices (21 and 22) of the drying chamber are controlled by an electronic card (6) which several presence or proximity detectors (61) located inside the drying chamber are connected to.

When the user inserts his or her hands in the drying chamber, the detectors (61) send a signal to the electronic card (5) which causes the simultaneous actuation of the turbine motors (4*a* and 4*b*), said turbine motors remaining simultaneously operative for a predetermined time period or until the detectors (61) no longer detect the user's hands inside the drying chamber.

During the drying cycle, the water released from the user's hands falls due to gravity towards the bottom of the drying chamber (2) to be drained through a drain orifice located in the lowest part, which is on one of the sides of said chamber, as can be seen in FIGS. 2 and 8, towards a drain duct (24).

Figure 1:
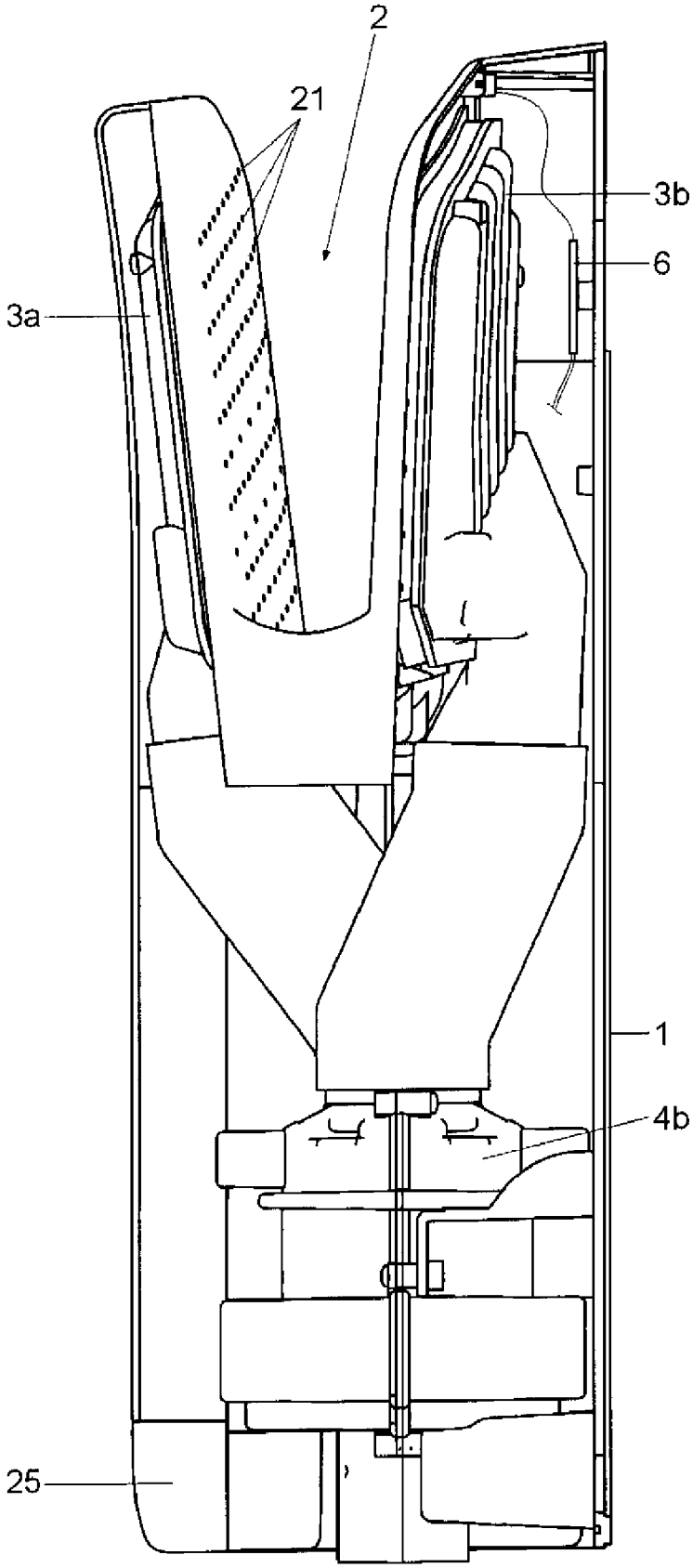
FIG. 1 shows a profile view of the hand dryer partially sectioned by a vertical plane, a lower tray being provided in this case for collecting the water from the drying chamber.

As shown in FIGS. 1 and 6 the dryer can have an extractable tray (25) inside the casing for collecting the water entering said tray through the aforementioned drain duct (24).

Optionally and as is shown in FIG. 2, the dryer can have an evaporation device (7) inside the casing instead of the tray (25), such device being responsible for evaporating the water from the drying chamber (2) and for expelling it in the form of step towards the outside of the dryer.

Figure 10:
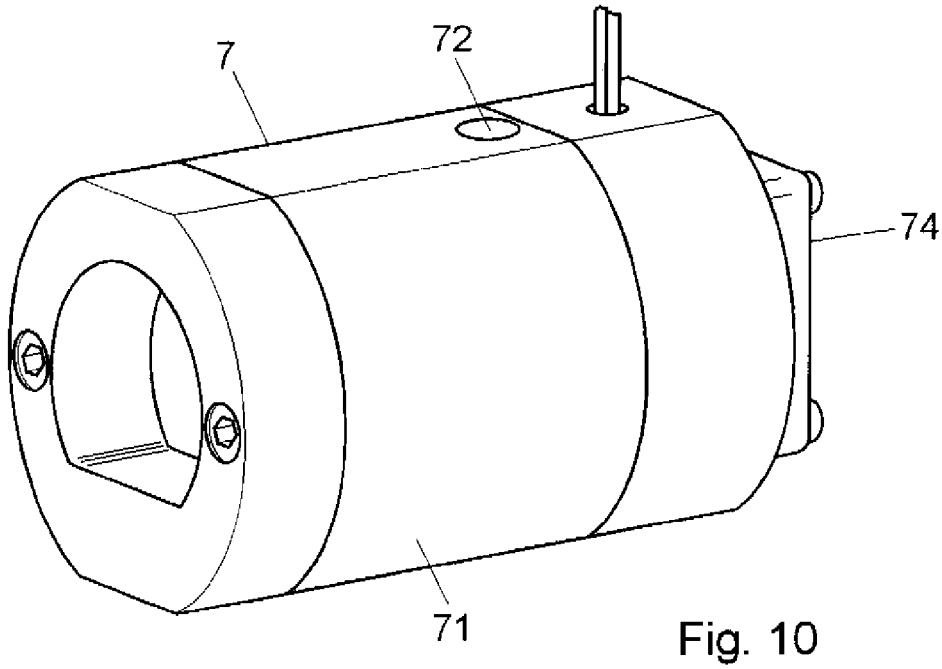
FIG. 10 shows a perspective view of the water evaporation device used in the dryer of the FIG. 2.
Figure 11:
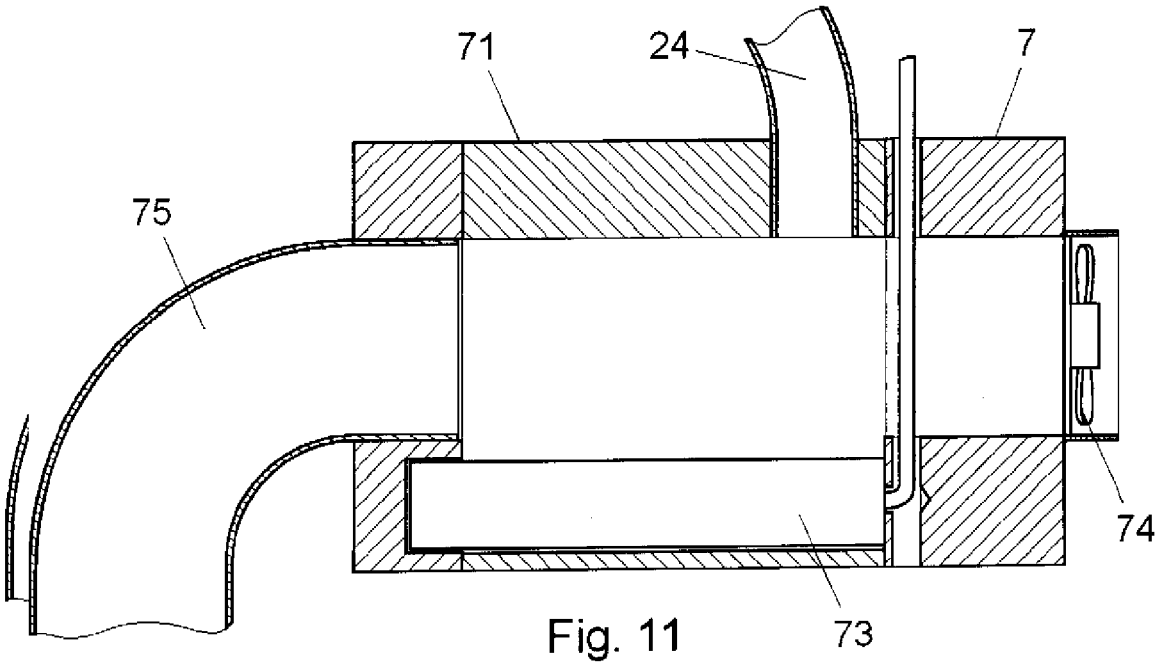
FIG. 11 shows an elevational view of an embodiment of the water evaporation device of the previous figure longitudinally sectioned by a vertical plane.
Figure 12:
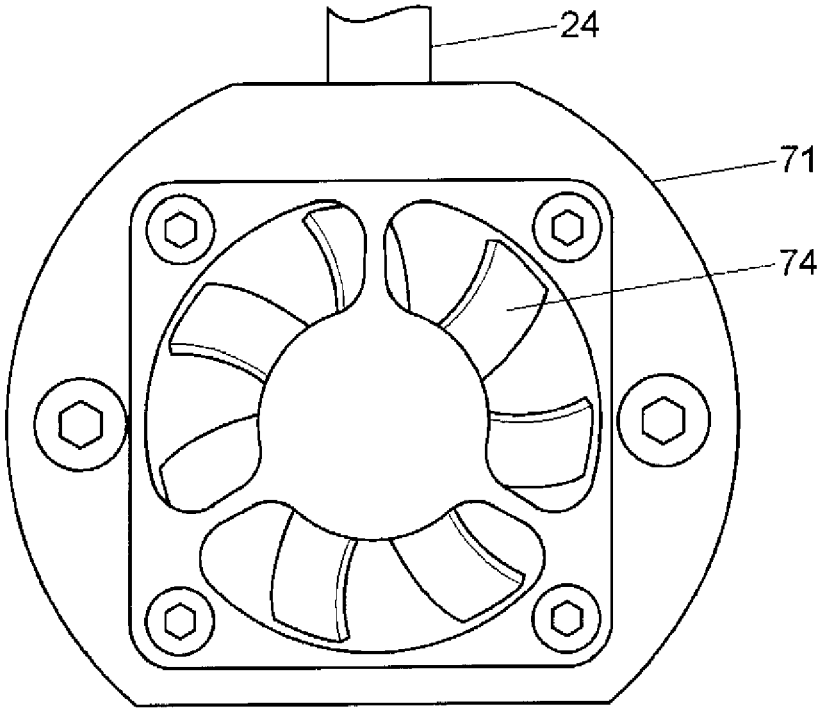
FIG. 12 shows a profile view of the evaporation device, in which the ventilator responsible for propelling the steam towards the outside of the dryer can be seen.

In the example shown in FIGS. 10, 11 and 12, the evaporation device (7) comprises a tubular body (71) arranged in an inclined position inside the casing (1) and provided with an upper mouth (72) for the connection of the drain duct (24) responsible for conducting the water from the drying chamber (2) towards the inside of said tubular body.

An electrical resistor (73) connected to the electronic control plate (6) is assembled inside the tubular body (71). There are assembled externally on the opposite ends of the tubular body (71) a ventilator (74) responsible for moving the water evaporated by the resistor (73) towards the outside and an elbow (75) through the inside of which the steam is moved towards the outside of the casing (1).

Figure 13:
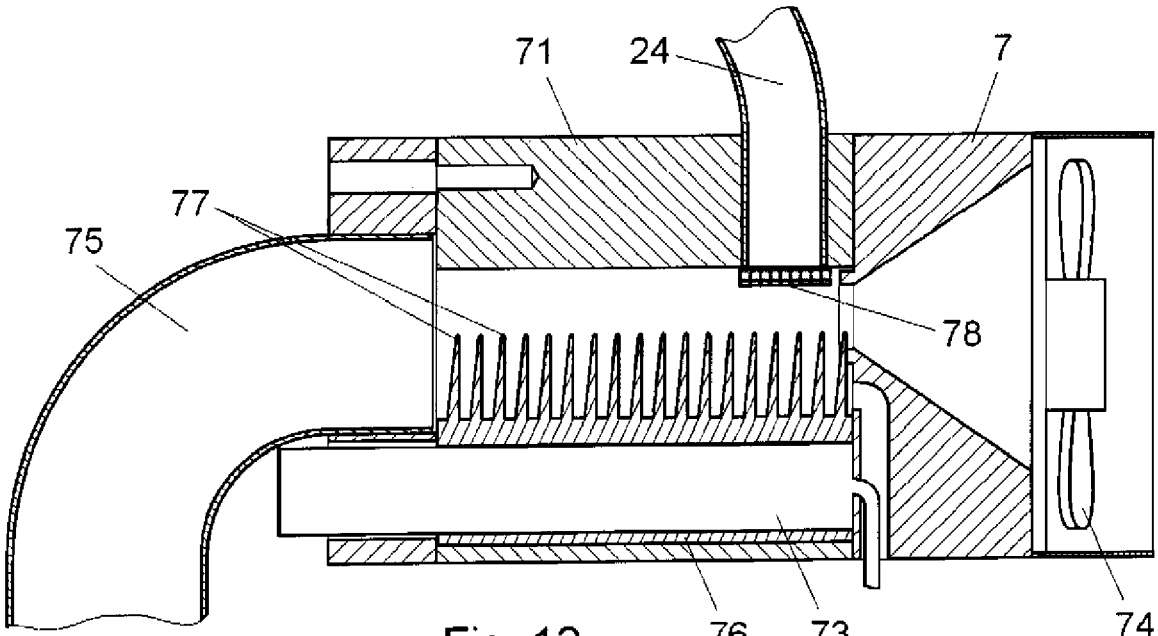
FIG. 13 shows an elevational view of an embodiment variant of the evaporation device, sectioned by a vertical plane and in which the electrical resistor is housed in a heat conductive sleeve and provided with cooling fins.

Optionally and as shown in the embodiment of FIG. 13, the resistor (73) can be housed in a heat conductive sleeve (76) provided with cooling fins (77) to optimize the heat transfer of the resistor (73).

In this case it has been provided that the upper mouth (72) through which the water to be evaporated gains access to the inside of the body (71) incorporates a grating or screen (78) for the separation of the water from the drying chamber into fine drops, which will facilitate its evaporation when said drops fall onto the fins (77).

Having sufficiently described the nature of the invention as well as a preferred embodiment, it is hereby stated for all intents and purposes that the materials, shape, size and arrangement of the described elements may be modified provided that such modification does not entail an alteration of the essential features of the invention which are claimed below.

The invention claimed is:

1. A hand dryer comprising:

a casing (1), a drying chamber (2) integrated in the casing for inserting hands, means for propelling air at room temperature at a high speed through an air circulation chamber towards the inside of the drying chamber, presence and proximity detectors (61) for the automatic actuation of the dryer when the user inserts his or her hands in the drying chamber (2), an electronic control card (6), means for collecting the water released from the user's hands during drying, at least two air outlets arranged in opposite walls of the drying chamber (2), and two flat hollow air circulation chambers (3*a*, 3*b*) inside the casing which are parallel to the front and back walls of the drying chamber (2) and demarcated by respective pairs of mutually opposite front and back plates (31, 32); said hollow chambers (3*a*, 3*b*) comprising inner channels (33) for the conduction and distribution of air through the inside of said hollow chambers with a low coefficient of friction, minimizing the formation of whirlpools during its circulation through the inside of said hollow chambers, a mouth (36} for the inlet of high-speed air propelled by the air propulsion means (4*a*, 4*b*), and a plurality of air outlet orifices (34) defined in the front plates (31) of the hollow chambers which project air simultaneously on the entire surface of the user's hands inserted and held still inside the drying chamber (2); said hollow chambers (3*a*, 3*b*) are arranged, respectively, between the front walls of the drying chamber and of the casing, and between the back walls of the drying chamber and of the casing.

2. The dryer of claim 1, in which the opposite walls of the drying chamber (2) have a plurality of orifices (21, 22) distributed on their entire surface.

3. The dryer of claim 1, in which the outlet orifices (34) defined in the front walls (31) of the hollow chambers (3*a*, 3*b*) face the respective orifices (21, 22) defined in the opposite walls of the drying chamber (2).

4. The dryer of claim 1, in which the hollow chambers (3*a*, 3*b*) have a surface that is equal to or somewhat smaller than the surface of the opposite walls of the drying chamber and in that the air outlet orifices (21, 22) are distributed both horizontally and vertically in said walls.

5. The dryer of claim 1, in which the front plates (31) of the hollow chambers (3*a*, 3*b*) externally have tubular extensions (35) arranged in correspondence with the air outlet orifices (34), said orifices (34) having a decreasing section throughout the tubular extensions (35).

6. The dryer of claim 1, in which the front and back walls of the casing (1), the opposite walls of the drying chamber (2) and the plates (31, 32) forming the hollow chambers (3*a*, 3*b*) have complementary fitting means for the overlapping or sandwich-type coupling.

7. The dryer of claim 1, in which the high-speed air propulsion means (4*a*, 4*b*) are actuated simultaneously at the beginning of the drying cycle and remain simultaneously operative during said drying cycle, projecting high-speed air simultaneously through all of the outlet orifices (34) towards the drying chamber (2).

8. The dryer of claim 1, in which the air propulsion means comprise two turbine motors (4*a*, 4*b*) housed inside the casing (1) and connected directly to the respective inlet mouths (36) of the hollow chambers (3*a*, 3*b*).

9. The dryer of claim 1, in which the drying chamber (2) is open vertically towards the upper area of the casing (1) and laterally in divergent directions towards the front of the dryer, said drying chamber (2) having a "V"-shaped configuration in plan view with the intermediate edge or vertex oriented towards the back middle area of the casing (1).

10. The dryer of claim 1, further comprising an evaporation device (7) for the evaporation of the water from the drying chamber (2), said device including: a low-power electrical resistor (73) controlled by the electronic control card (6) and a ventilator (74) propelling the steam to the outside of the casing (1).

11. The dryer of claim 10, in which the electrical resistor (73) is housed inside a tubular body (71), arranged in a considerably horizontal position inside the casing (1) and having at the upper portion a mouth (72) for the connection of the drain duct (24) to drain the water from the drying chamber (2).

12. The dryer of claim 10, in which the ventilator (74) is assembled on one of the end mouths of the tubular body (71), an outlet duct {75) for the steam to exit to the outside of the casing (1) being connected to the opposite mouth of said tubular body.

13. The dryer of claim 10, in which the resistor (73) is housed inside a heat conductive sleeve (76) having cooling fins (77).

14. The dryer of claim 11, in which the tubular body {71) has a screen or grating (78) in the upper mouth (72) for separating the water from the drying chamber (11) into fine drops or particles.

* * * * *